US005978984A

United States Patent [19]

Gobbers et al.

[11] Patent Number: 5,978,984

[45] Date of Patent: Nov. 9, 1999

[54] APPARATUS FOR USE IN A BATHTUB AS AN ENTRY AND EXIT AID

[76] Inventors: Walter Gobbers; Dieter Gobbers, both of Brüderstrasse 11, 89415 Lauingen, Germany

[21] Appl. No.: 09/119,489

[22] Filed: Jul. 20, 1998

[30] Foreign Application Priority Data

Jul. 24, 1997 [DE] Germany ..... 197 31 832

[51] Int. Cl.[6] ..... A47K 3/02

[52] U.S. Cl. ..... 4/565.1; 4/564.1; 4/560.1

[58] Field of Search ..... 4/565.1, 564.1, 4/560.1, 561.1, 566.1, 604, 611

[56] References Cited

U.S. PATENT DOCUMENTS

| | | | |
|---|---|---|---|
| 2,968,814 | 1/1961 | Ashby, Jr. | 4/564.1 |
| 4,407,029 | 10/1983 | Schmidt | 4/564.1 |
| 5,708,992 | 1/1998 | Gobbers et al. | 4/565.1 |

*Primary Examiner*—David J. Walczak
*Attorney, Agent, or Firm*—Taylor & Associates, P.C.

[57] ABSTRACT

An apparatus for use in a bathtub as an entry and exit aid includes a seat which can be raised and lowered by a drive, a backrest, and an actuator which is placed between the drive and the seat. The actuator includes a support which engages the seat and which extends downwardly to prop itself on a support area, i.e., a floor plate of the device, thereby lifting the seat as the support extends downwardly. The backrest can be tilted backward when the seat is in or near its lowest position.

6 Claims, 4 Drawing Sheets

APPARATUS FOR USE IN A BATHTUB AS AN ENTRY AND EXIT AID

BACKGROUND OF THE INVENTION

1. Field of the Invention

The present invention relates to relates to a device for use in a bathtub or in similar equipment to assist in getting in and out. Please refer to German Patent Document No. DE 44 37 513 A1.

2. Description of the Related Art

Devices to aid in entry and exit from a bathtub are helpful or indispensable for older or infirm persons. They facilitate safe and comfortable entry into and exit from a bathtub, a wash tub, or similar equipment.

In each instance, the basic design is equipped with a seat. In general, the seat is supported by a scissors-like frame, whose scissor arms are adjustable, thereby providing height adjustability of the seat. There are also several options regarding the drive. The drive may be an electric motor or a pneumatic device, or it may utilize the water pressure of the public water supply.

The known devices have had only limited success. Again and again, the weak points are lack of safety, excessive weight and poor operating convenience.

One of the problems is caused by the backrest of such devices. The devices are often removed from the bathtub after use and stored in a different location. To reduce space requirements, it is desirable to fold the backrest, so that it is parallel to the seat area. It is also desirable to configure the backrest in such a way that it can adapt to various angular positions. Particularly here, the aspect of operational convenience plays an important role.

SUMMARY OF THE INVENTION

The present invention provides a device with improved handling during use, as well as during setting up and storage, particularly with regard to the adjustability of the angle of the backrest.

The backrest automatically tilts backward in the sitting position of the user at an angle that provides a relaxed position for the user. There is no need for manual adjustment which would be particularly difficult for older or infirm persons.

When the user wants to get out of the tub, the seat rises upward as required, driven by any of the previously referred to drives, with the person sitting on it. Because of the aforementioned automation of backrest adjustment according to the invention, the backrest is brought from the backwardly tilted position (relaxation position) into an upright position, in which the backrest is substantially perpendicular to the seat. When the seat is in its uppermost position, the user can exit the tub comfortably with the backrest still perpendicular to the seat. As previously mentioned, it is desirable to fold down the backrest, so that it rests on the seat. It is, however, desirable that the folding down is accomplished in such a way that the backrest does not fold down while the user is exiting the tub. A locking device is provided which prevents folding down of the backrest onto the seat and which can be easily released by the user.

The locking device includes, for example, a holding claw which is positioned at the bottom of the backrest and which engages into a catch on the underside of the seat. The holding claw pivots into the catch as well as out of the catch. The holding claw may be actuated by use of a linkage which reaches to the top of the backrest and which can be operated from there. The linkage may, for example, effect the pivot action of the holding claw by moving up and down. The up and down movement may be accomplished through an eccentrically mounted twist handle, which acts on the linkage.

German Patent Document No. DE 297 04 769 U1 describes a similar device. However, the upper end of the lifting device on the backrest is pivoted around a transverse axis. This device is complicated in design and does not provide the advantages of the present invention.

In order to effect lifting and lowering of the seat, it is known to provide a support which engages the seat. This support can be extended downwardly in order to prop itself on a support area, which would generally be the floor of the bathtub, thereby causing lifting of the seat corresponding to the extension movement. A support of this type is known from the aforementioned patent specification German Patent Document No. DE 44 37 513 A1. See, for example, the design variations according to FIGS. 1 through 5 or 9 through 11.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
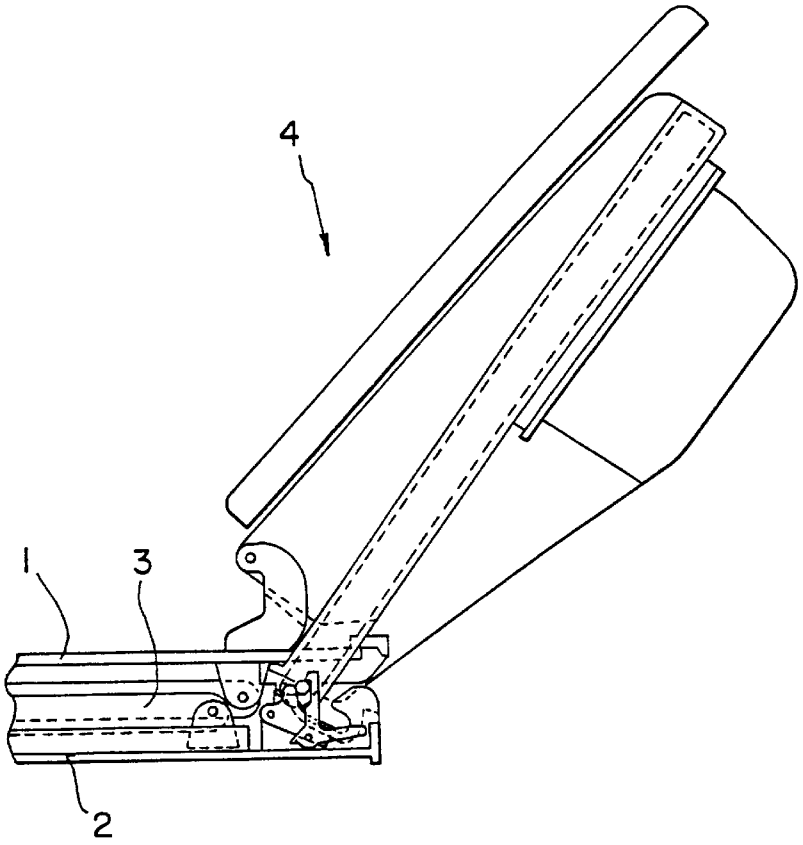
FIG. 1 is a fragmentary, side view of one embodiment of an apparatus of the present invention.

Referring now to the drawings and particularly to FIG. 1, there is shown a seat 1, a floor plate 2, a scissors-like frame 3 and a backrest 4. The backrest 4 is equipped with an integral support 5 which can be extended downwardly. The further support 5 is extended, the higher the position of the seat 1 above floor plate 2.

The backrest 4 is hinged at joint 1.2 on a bracket 1.1 which is firmly connected with the seat 1. The backrest 4 can be pivoted at various angles relative to seat 1. FIG. 1 illustrates the angle at which the backrest 4 is pivoted furthest back. This angle could be described as the "relaxation position" since it is the position in which the user enjoys his bath.

Figure 2:
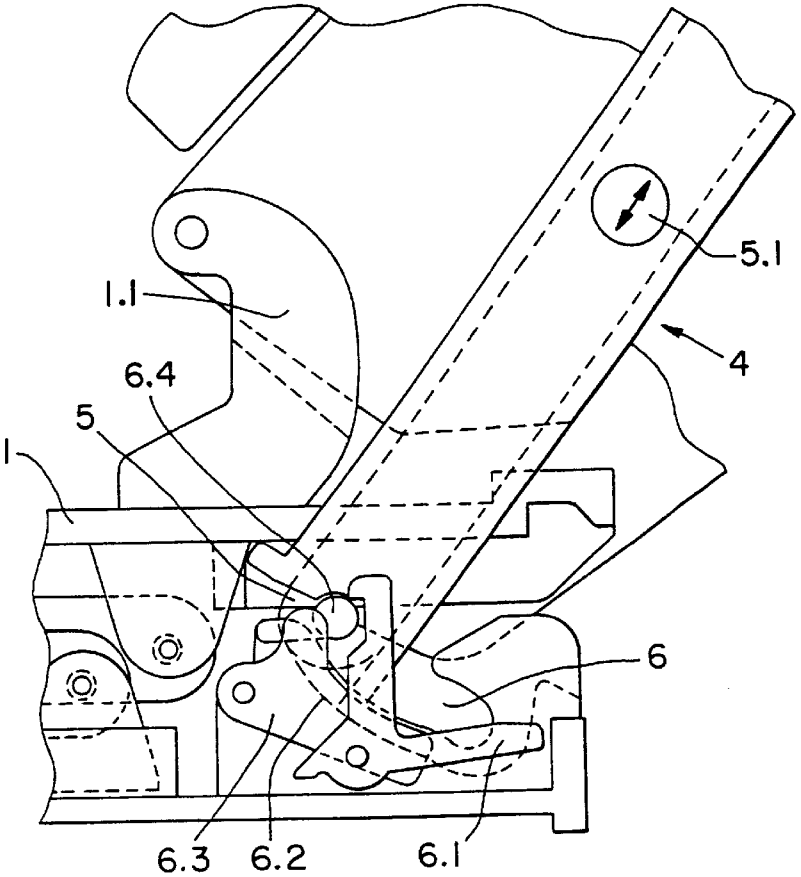
FIG. 2 is an enlarged, fragmentary view of the apparatus of FIG. 1.
Figure 4:
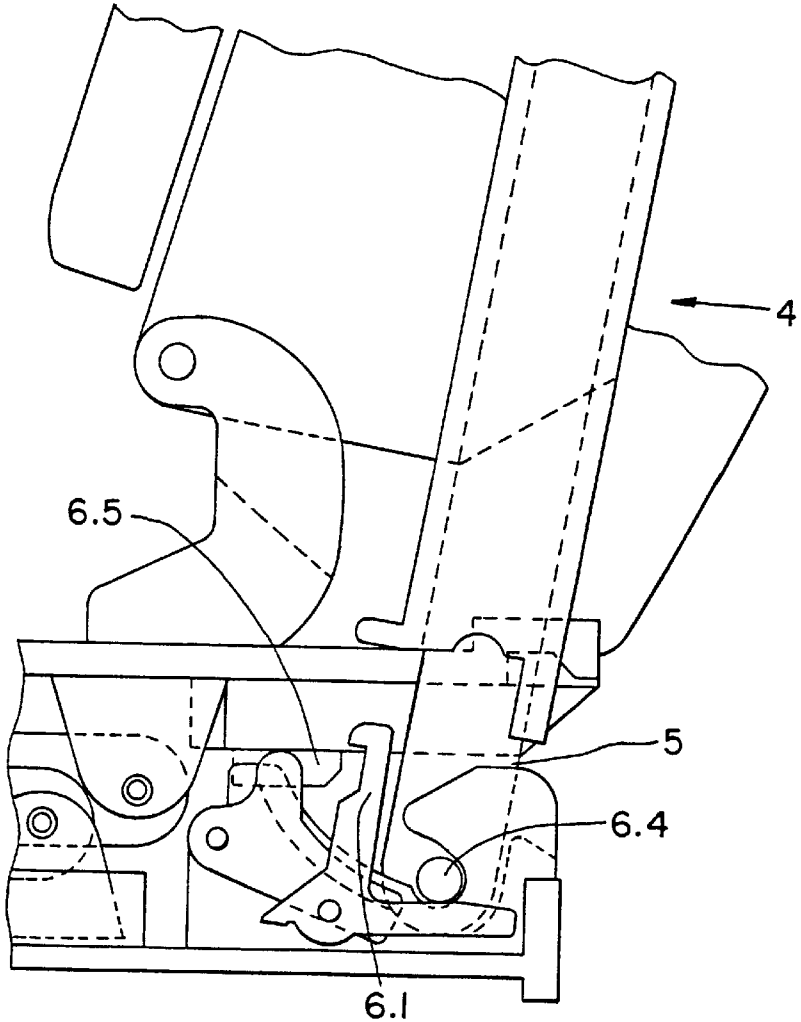
FIG. 4 is an enlarged, fragmentary view of the apparatus of FIG. 3.
Figure 6:
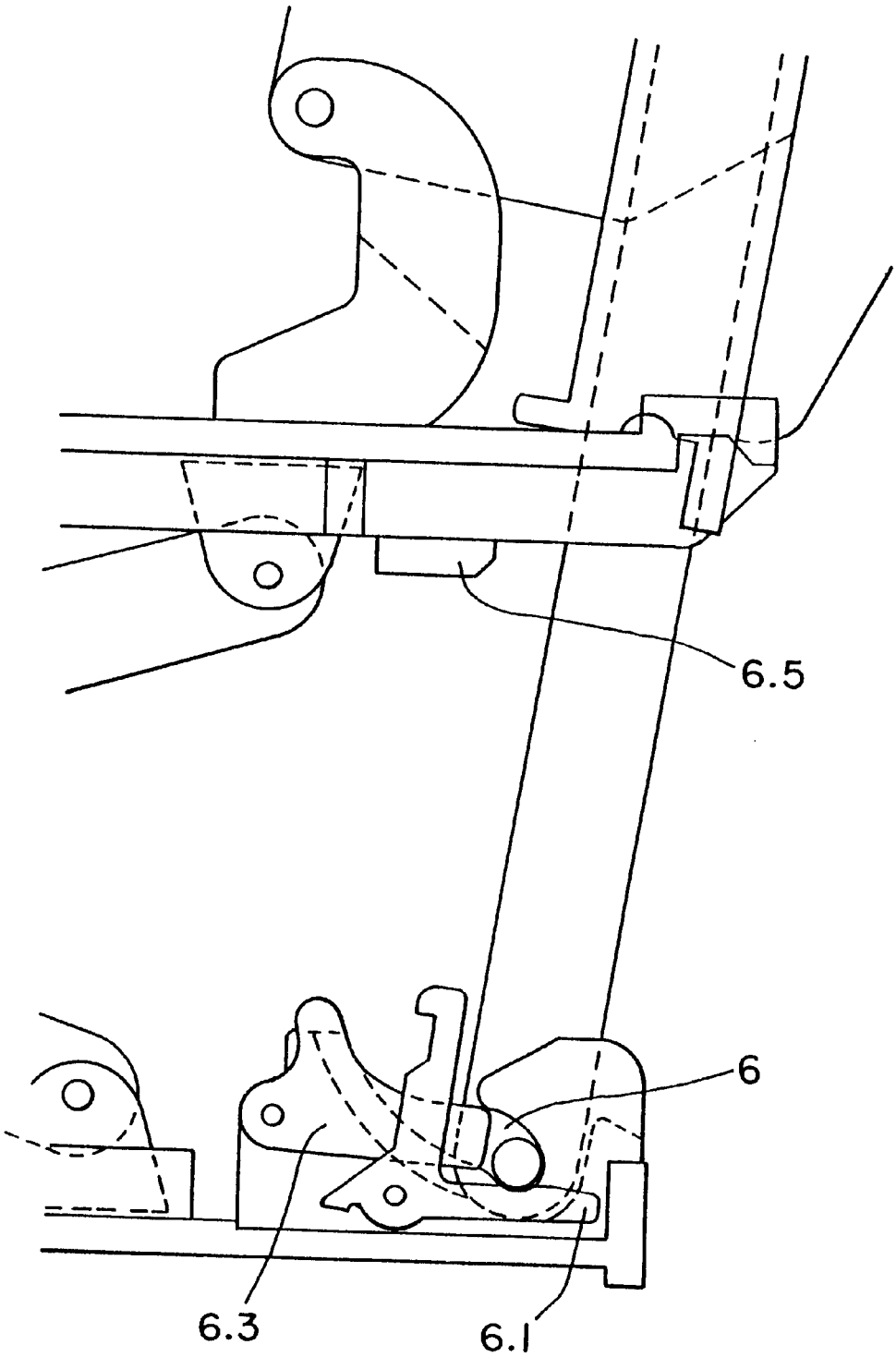
FIG. 6 is an enlarged, fragmentary view of the apparatus of FIG. 5.

FIGS. 2, 4 and 6 very clearly show the mechanism which is responsible for -tilting the backrest 4 backwards when the "relaxation position" (lowest position of seat 1) has been reached. Among other components, this mechanism includes a connecting link 6, a latching lever 6.1, a ramp 6.2 with a running surface, a pawl 6.3, a journal 6.4 which is a component of support 5, and a latching plate 6.5. A driving mechanism 5.1 actuates support 5 and is shown schematically in FIG. 2.

Figure 3:
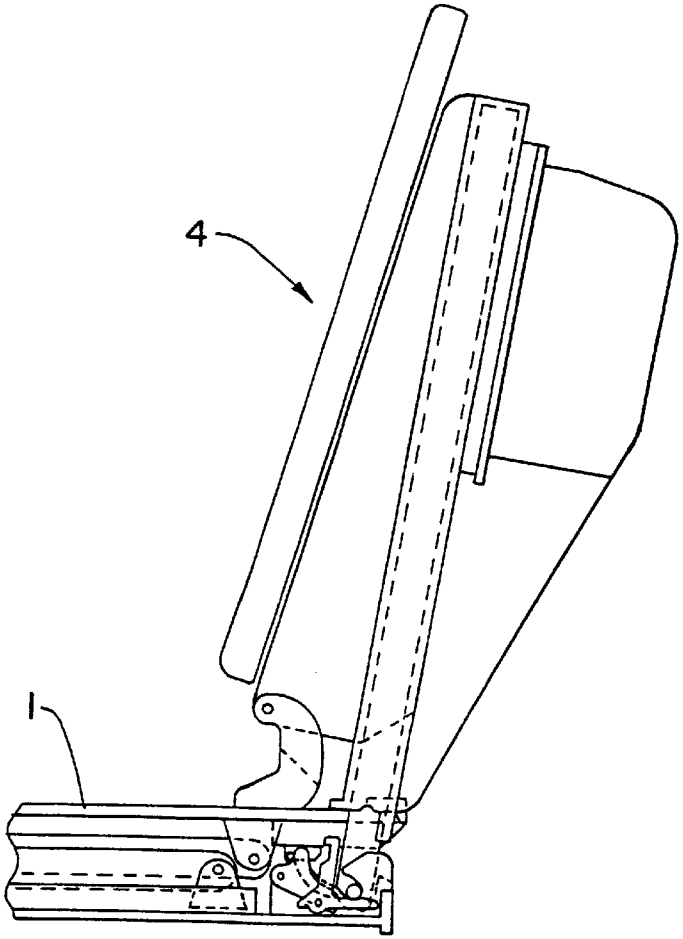
FIG. 3 is a fragmentary, side view of the apparatus of FIG. 1 in an upright position.

FIG. 3 shows the position in which the seat 1 is in its lowest position. However, support 5 is extended so that the backrest 4 is positioned substantially perpendicular to seat 1.

Figure 5:
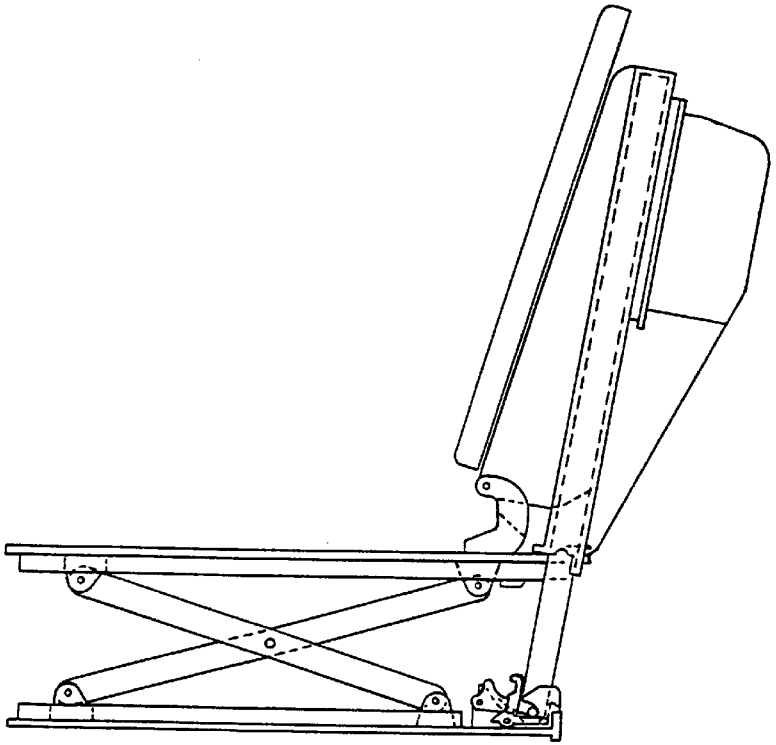
FIG. 5 is side view of the apparatus of FIG. 3 with the seat in a raised position.

The illustration in FIG. 5 shows that the latching lever 6.1 is actuated by the journal 6.4 on support 5, thus releasing seat 1.

FIG. 6 illustrates the position in which seat 1 is in an upper position. Accordingly, pawl 6.3 is no longer engaged or biased downwardly by seat 1. As a result, support 5 is locked in link 6 by pawl 6.3. The latching lever 6.1 is engaged in this position.

When it is desired to tilt backrest 4 backwards. drive mechanism 5.1 is actuated in order to lower seat 1. As best seen in a comparison of FIGS. 4 and 6, a bottom surface of seat 1 pushes downwardly on a top surface of pawl 6.3, thereby rotating pawl 6.3 about its pivot. In the fully downwardly rotated position of pawl 6.3 in FIG. 4. pawl 6.3 no longer locks journal 6.4 in link 6. The user can then lean backwards on backrest 4 in order to pivot backrest 4 about joint 1.2. As backrest 4 rotates, it carries support 5 along with it, thereby causing journal 6.4 to slide along upwardly on the arcuate running surface of ramp 6.2. Journal 6.4 releases its downward bias on latching lever 6.1 as journal 6.4 exits link 6, thereby allowing latching lever 6.1 to rotate in a counterclockwise direction, as viewed from the perspective of the drawings. The upper end of latching lever 6.1 then latches onto support plate 6.5 in order to prevent seat 1 from moving in a direction away from floor plate 2. The user can continue to push backrest 4 backwards until it reaches the fully reclined position of FIG. 2.

As mentioned, the device is constructed so that the backrest 4 can also be folded forward so that it rests on the seat 1. This folding action facilitates the removal of the entire device from the tub in order to store it elsewhere.

Figure 7:
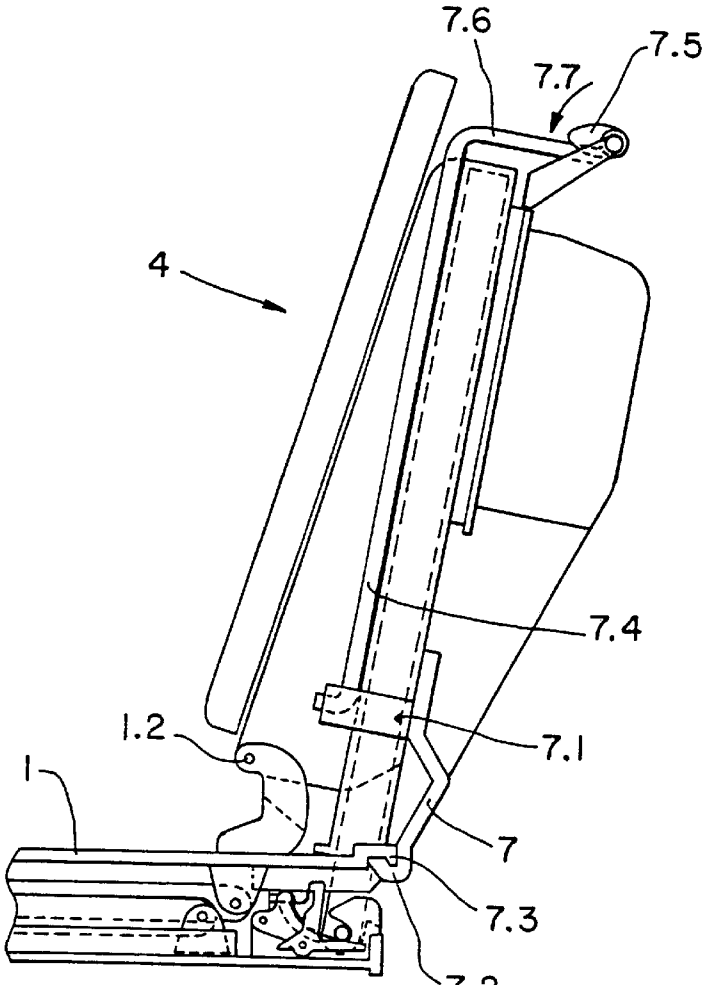
FIG. 7 is a fragmentary, side view of the apparatus of FIG. 3 including the backrest lock mechanism.

Features related to folding are shown in FIG. 7, and have been omitted from FIGS. 1–6 for purposes of clarity. A claw 7 is hinged through a joint 7.1 onto backrest 4. In the illustrated position, the lower end 7.2 of claw 7 engages in a catch 7.3 which is part of seat 1. In this position, forward tilting of the backrest 4 is not possible.

Linkage 7.4 is also illustrated. This is movable both toward and away from the seat. In the upper area of the entire device there is a twist handle 7.5. This may have a circular cross section and be eccentrically mounted. As illustrated in this instance, it may also have an elliptical cross section, again eccentrically mounted. Thrust rod 7.6 is bent at a right angle and acts as a pressure bar. Thrust rod 7.6 is turned in the direction of the arrow 7.7 by turning the twist handle 7.5. This results in the linkage 7.4 and also claw 7 moving downward so that the lower end 7.2 releases catch 7.3. The claw pivots backward around the pivot point so that backrest 4 folds forward, pivoting around joint 1.2.

The described mode of operation, can be executed from above. The user therefore, does not have to bend over. There is also no need to have to feel for the position of claw 7, which could be difficult when the backrest is tilted.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for aiding entry into and exit from a bathtub, said apparatus comprising:

a seat;

a driving mechanism configured for raising and lowering said seat;

a floor plate;

a support disposed between said driving mechanism and said seat, said support engaging said seat, said support being downwardly extendable to engage said floor plate, thereby raising said seat as said support extends downwardly; and a backrest associated with said seat, said backrest having a fixed angular orientation relative to said support, said backrest being backwards tiltable only when said seat is within a predetermined distance of said floor plate.

2. The apparatus of claim 1, further comprising a running surface, said support being configured to rest upon and slide along said running surface, said support also being, configured to cooperate with said running surface in order to tilt said backrest.

3. An apparatus for aiding entry into and exit from a bathtub, said apparatus comprising:

a seat;

a driving mechanism configured for raising and lowering said seat;

a floor plate;

a support disposed between said driving mechanism and said seat, said Support engaging said seat, said support being, downwardly extendable to engage said floor plate, thereby raising said seat as said support extends downwardly;

a backrest associated with said seat, said backrest being backwards tiltable when said seat is within a predetermined distance of said floor plate, said backrest also being forwardly foldable; and a locking mechanism configured for latching said backrest in order to prevent unintentional forward folding of said backrest, said locking mechanism comprising:

a catch associated with said seat;

a claw pivotally mounted on said backrest, said claw being configured for engaging with said catch;

a linkage configured for engaging and disengaging said claw with said catch; and an eccentrically mounted twist handle having an axis, said twist handle being configured for being rotated about said axis, thereby actuating and exerting pressure on said linkage.

4. The apparatus of claim 3, wherein said locking mechanism further comprises a thrust rod connected to said linkage, said twist handle being configured for exerting pressure on said thrust rod.

5. The apparatus of claim 2, wherein said running surface is arcuate.

6. The apparatus of claim 1, wherein said backrest is parallel and adjacent to said support.

* * * * *